United States Patent [19]

Cho

[11] Patent Number: 4,827,181

[45] Date of Patent: May 2, 1989

[54] FOCUSING ELECTRODES OF AN ELECTRON GUN FOR USE IN A COLOR TELEVISION CATHODE RAY TUBE

[75] Inventor: Seog-Lae Cho, Kyungki-do, Rep. of Korea

[73] Assignee: Samsung Electron Devices Co., Ltd., Rep. of Korea

[21] Appl. No.: 53,400

[22] Filed: May 22, 1987

[30] Foreign Application Priority Data

Mar. 7, 1987 [KR] Rep. of Korea ..... 87-2051

[51] Int. Cl.[4] ..... H01J 29/62

[52] U.S. Cl. ..... 313/414

[58] Field of Search ..... 313/414

[56] References Cited

U.S. PATENT DOCUMENTS 4,119,884 10/1978 Blumenberg ..... 313/414

FOREIGN PATENT DOCUMENTS 11459 1/1982 Japan ..... 313/414

59-47 1/1983 Japan ..... 313/414

44655 3/1983 Japan ..... 313/414

*Primary Examiner*—Palmer C. DeMeo

*Attorney, Agent, or Firm*—Handal & Morofsky

[57] ABSTRACT

The present invention relates to focusing electrodes of an electron gun for use in a color television cathode ray tube and, more particularly, to focusing electrodes, wherein a third focusing electrode is united with a long extension member, comprising an elongated tube, an attenuation tube and another elongated tube, to which the third focusing electorde is electrically connected and a fourth focusing electrode is united with a short extension member, comprising an elongated tube and an attenuation tube, to which the fourth focusing electrode is electrically connected.

The said improved structure is provided to reduce a local voltage difference as well as an influence from high potential field in the neck region so that a good convergence can be obtained and to offset an astigmatism so that a better picture on the screen can be provided.

8 Claims, 2 Drawing Sheets

PRIOR ART

FOCUSING ELECTRODES OF AN ELECTRON GUN FOR USE IN A COLOR TELEVISION CATHODE RAY TUBE

BACKGROUND OF THE INVENTION

1. Field of the Invention

The present invention relates to focusing electrodes in an electron gun for use in a color television cathode ray tube and, more particularly, to focusing electrodes, wherein a third focusing electrode is united with a long extension member to which the third focusing electrode is electrically connected and a fourth focusing electrode is united with a short extension member to which the fourth focusing electrode is electrically connected.

2. Description of the Prior Art

A color television has an electron gun comprising cathodes generating three red, green and blue electron beams and various grid electrodes accelerating and focusing these beams. The electron gun may be of the delta configuration or in-line type, both of which produce three focused electron beams, form spots on a screen and further, reproduce an image.

It is generally known that main elements of the electron gun which form a spot are a third electrode and a fourth electrode. When these electrodes are energized at different voltages, these electrodes form a main electron lens in themselves and thereby, cause electron beams to be focused on the multiple phosphor groups located on the faceplate of a color cathode ray tube.

FIG. 5 is a sectional view of the third electrode and the fourth electrode in a general electron gun. The third electrode G3 and the fourth electrode G4 have three apertures a1, a2 and a3 and b1, b2 and b3, respectively, as beam paths. The middle aperture b2 is aligned with the adjacent middle aperture a2 to provide a substantially symmetrical beam focusing electric field between apertures a2 and b2 when electrodes G3 and G4 are energized with different voltages. The two outer apertures b1 and b3 are slightly offset outwardly with respect to the corresponding outer apertures a1 and a3, to provide an asymmetrical electric field between each pair of outer apertures when electrodes G3 and G4 are energized, to individually focus each outer beam near the screen, and also to deflect each outer beam toward the middle beam to a common point of convergence with the middle beam near the screen.

With respect to an electron gun of in-line type, a convergence angle is obtained from the following general expression:

$$\theta = K \cdot (d/D) \cdot (Eb/Vf)$$

$\theta$: Convergence angle
K : Constant
D: Diameter of beam paths in a third electrode
d: Asymmetrical distance
Vf: Voltage in a third electrode
Eb: Voltage in a fourth electrode.

It is known from the above general expression that the convergence angle $\theta$ is proportional to the voltage ratio of main electron lens Eb/Vf and the asymmetrical distance d.

The aforementioned in-line electron gun has structural deficiencies in that it is inevitable that it will generate a difference in focus voltages in three guns and cause convergence error and thereby, the picture quality on the periphery of the screen becomes indistinct.

The difference of focus voltages occurs for the following reasons. Firstly, a local voltage difference of 100–200 Volts is generated by the diameter difference between two outer apertures b1 and b3 and the middle aperture b2 in the fourth electrode G4. Secondly, focus is affected by the high potential field in the neck region encompassing the electron gun. The deteriorated picture occurs on the peripheral part of the screen, because beam spots shown in FIG. 6 become elliptical on the peripheral part of the screen by means of astigmatism occurring at the time of deflecting beams.

There has been provided an electron gun which removes the above disadvantages by means of enlarging the main focusing lens and thereby, decreasing the effect on the focus voltage difference.

One example is an "embodiment of in-line electron gun" described as in 79-49862 in the Japanese Utility Model Gazette for laying-open of unexamined applications. With respect to said electron gun, the opposite faces of the third and fourth electrodes are formed to be deepdrawn inwardly so that the distance between each three apertures of the third and fourth electrodes becomes more distant and thereby, it is tried to decrease spherical aberration. But this electron gun cannot obtain the desired result because mutual interference is deeply generated among the potential distribution of electron beams R, G and B forming between the third and fourth electrodes.

As another prior art for eliminating mutual interference of the potential distribution, there is a "unitized electron gun having electrodes with internal beam shielding tubes" described and claimed in the U.S. Pat. No. 4,119,884. This electron gun is of the so-called discrete type in that there electron guns are positioned separately. It is able to eliminate mutual interference of the potential distribution of electron beams R, G and B, but incapable of improving the effect on the high potential received from the neck region and the deterioration of picture quality forming on the peripheral part of the screen due to astigmatism.

SUMMARY OF THE INVENTION

It is an object to provide focusing electrodes of an electron gun for use in a color television cathode ray tube, wherein a third focusing electrode is united with a long extension member to which the third focusing electrode is electrically connected and a fourth electrode is united with a short extension member to which the fourth focusing electrode is electrically connected. The improved structure is provided to reduce a local voltage difference as well as an influence from high potential field in the neck region so that good convergence can be obtained and to offset an astigmatism so that deterioration of picture quality can be prevented.

In short, the long and short extension members function to substantially divide the main electron lens between the third and fourth electrodes so that the paths of three R, G and B beams are formed. Also these members function to protect inner potential distribution from an influence by outer high voltage, and to intensely focus horizontal component than vertical component among electron beams passing by the third and fourth electrodes so that they can improve an astigmatism occurring at the time of deflecting the beams.

BRIEF DESCRIPTION OF THE DRAWINGS

The above and other objects and features of the present invention will appear more fully hereinafter from a consideration of the following description taken in connection with the accompanying drawings.

DETAILED DESCRIPTION OF THE INVENTION

Figure 1:
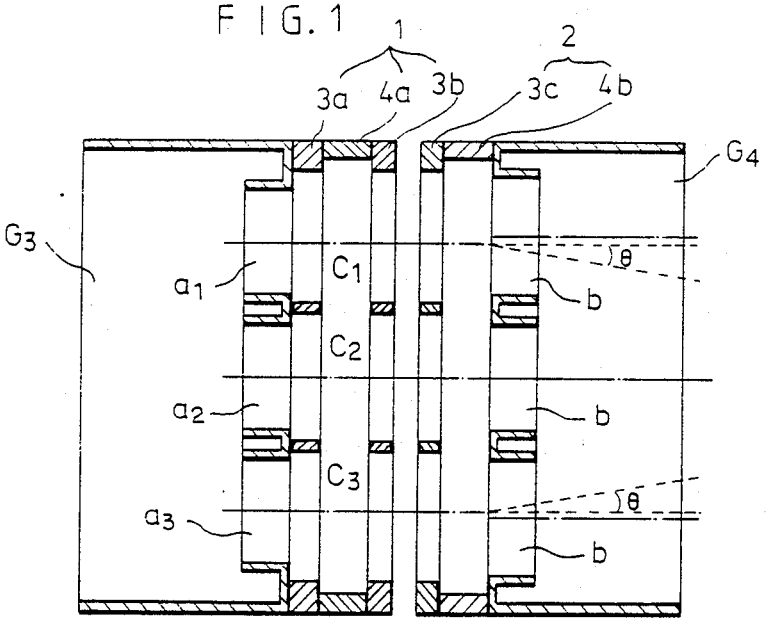
FIG. 1 is a sectional view of focusing electrodes according to the embodiment of the present invention.

FIG. 1 illustrates a structure of focusing electrodes embodying the present invention.

A third electrode G3 and a fourth electrode G4 have a long extension member 1 and a short extension member 2, respectively. The long extension member 1, comprises an elongated tube 3*a*, an attenuation tube 4*a* and an elongated tube 3*b* in order, united with each other and further, with the third electrode G3 to which the long extension member 1 is connected.

The short extension member 2, comprises an elongated tube 3*c* and an attenuation tube 4*b* in order, united with each other and further, with the fourth electrode G4 to which the short extension member 2 is connected.

The elongated tubes 3*a*, 3*b* and 3*c* have inner apertures c1, c2 and c3 as beam paths, all of which are of the same size of diameter. A central axial line of the said apertures c1, c2 and c3 is formed to be aligned with apertures a1, a2 and a3 in the third electrode G3, respectively.

Figure 2:
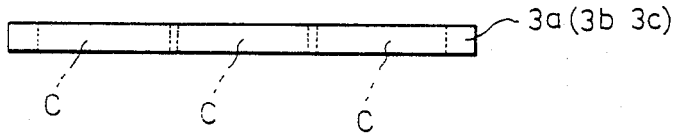
FIG. 2 is a side view of elongated tube shown in FIG. 1.

FIG. 2 is a side view of the said elongated tube 3*a*, 3*b* or 3*c* shown in FIG. 1.

The elongated tubes 3*a*, 3*b* and 3*c* are made of metal sheet with the thickness of 0.6 to 1.0 mm, respectively. Their inner beam paths apertures c1, c2 and c3 have somewhat larger diameter than in the case of the beam path apertures a1, a2 and a3 in the third electrode G3. The elongated tubes 3*a*, 3*b* and 3*c* are made of sheet metal and cause the main electron lenses to be enlarged in their horizontal diameter and mutual interference of potential distribution to be prevented without any technical difficulty in the deep-drawing process.

Figure 3:
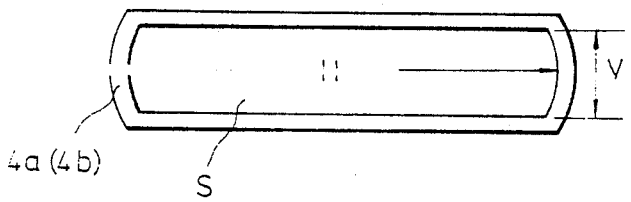
FIG. 3 is a front view of an attenuation tube shown in FIG. 1.

FIG. 3 is a front view of the attenuation tube 4a or 4b shown in FIG. 1.

The attenuation tube 4*a* or 4*b* has an opening hole S inwardly, which is formed with an elliptical type that horizontal diameter H is long and vertical diameter V is rather short. Owing to the attenuation tubes, two electron sub-lenses whose horizontal diameter is long and whose vertical diameter is rather short are formed near the main electron lenses.

The elongated tube 3*a*, the attenuated tube 4*a* and the elongated tube 3*b* are united with each other in order by a laser welding and consequently, become the long extension member 1. The long extension member 1 is united with the third electrode G3 by the same laser welding and the long extension member 1 is electrically connected to the third electrode G3.

The elongated tube 3*c* and the attenuation tube 4*b* are united with each other in order by a laser welding and consequently, become the short extension member 2. The short extension member 2 is united with the fourth electrode G4 by the same laser welding and the short extension member 2 is electrically connected to the fourth electrode G4.

According to the improved focusing electrodes embodying the present invention, the function and effect is explained as follows:

The attenuation tube 4*b*, united with the front of the fourth electrode G4 has the beam path apertures c1, c2 and c3 with the same size of diameter and so, the local focus voltage difference cannot be generated between the third and fourth electrodes G3 and G4, differently from the prior art.

Each of the elongated tubes 3*a*, 3*b* and 3*c* mutually divides each of the paths of the electron beams R, G and B between the third and fourth electrodes G3 and G4 and so, mutual interference of the potential distribution is held back.

The beam paths apertures b1, b2 and b3 in the fourth electrode causing the convergence are located on the inner parts of the short extension member 2 and so, an influence from the high potential field in the neck region is mostly constrained.

Also the distance between the beam paths apertures a1, a2 and a3 in the third electrode G3 and the beam paths apertures b1, b2 and b3 in the fourth electrode G4 becomes more distant than in the case of the prior art and so, the main lenses are formed to be enlarged in their horizontal diameters.

Pursuant to the above-mentioned function and effect, the convergence error can be minimized and the spherical aberration of lens can be reduced. Accordingly, a better picture can be formed on the screen.

Figure 4:
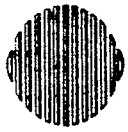
FIG. 4 is a grossly enlarged view of spot improved according to the present invention.
Figure 5:
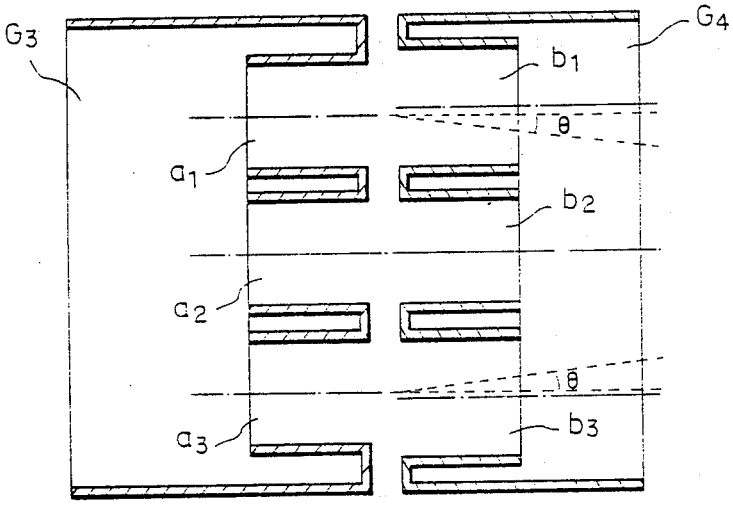
FIG. 5 is a sectional view showing the relation between the third and fourth electrodes according to a conventional in-line electron gun.
Figure 6:
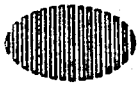
PRIOR ART FIG. 6
FIG. 6 is a grossly enlarged view of spot according to a conventional electron gun.

Each of the attenuation tubes 4*a* and 4*b* functions to form electron sub-lenses in the front and rear of the main electron lenses, respectively. The said electron sub-lenses do intensely focus the horizontal component rather than the vertical component among the electron beams and so, the spot shown in FIG. 4 becomes a somewhat vertical ellipse. Therefore it is possible to offset the astigmatism generated at the time of deflecting the electron beams and the distinctiveness of degree in the peripheral part becomes equal to that in the central part of the screen. At last, uniform picture quality can be achieved.

While there has been described what is at the present considered to be the preferred embodiment of the present invention, it will be understood that various modifications may be made therein, and it is intended in the appended claims to cover all such modifications as fall within the true spirit and scope of the present invention.

What is claimed is:

1. In an in line electron gun for a color television cathode ray tube of the type having a pair of spaced focusing electrodes, wherein each of said electrodes is an elongated, tubular element open at one end and having plural beam apertures in the opposite end, with the opposite end of each of said elements facing each other, the improvement comprising a long extension member having at least one elongated non-circular apertured means and a non-circular apertured attenuation means secured to said elongated means, said attenuation means being secured with respect to one of said focusing electrodes to connect said long extension member to said one electrode and a short extension member having an additional elongated non-circular apertured means and an additional non-circular apertured attenuation means secured to said additional elongated means, said additional attenuation means being also secured with respect to the other of said focusing electrodes to connect said short extension member to said other electrode.

2. The improvement of claim 1, wherein said attenuation means and said additional attenuation means have apertures with the same size inner dimensions.

3. The improvement of claim 2, wherein said elongated apertured means has apertures with inner dimension larger than the inner dimension of corresponding apertures of said focusing electrodes.

4. In an in line electron gun for a color cathode ray tube of the type having a multiple color phosphor screen and a three electron beam generating electron gun the improvement comprising first and second apertured focusing electrodes of elongated shape open at one end and having plural beam apertures at the other end, said first and second focusing electrodes being aligned with each other, and first and second apertured extension members, each of said focusing electrodes and said extension members having a central electron beam passing aperture and first and second outer electron beam passing apertures, said outer apertures being positioned on opposite sides of their respective central aperture, the central axes of the two outer electron beam passing apertures of said second focusing electrode being arranged outwardly of the central axes of the corresponding apertures of said first focusing electrode, said first extension member being electrically connected with the rear end of said first focusing electrode, said second extension member being electrically connected with the forward end of said second focusing electrode, said first extension member comprising a first apertured attenuation means having two opposite ends and being connected to a respective one of first and second sheet-like apertured electrodes, said second extension member comprising a second apertured attenuation means having two ends and third apertured sheet-like electrode, one end of said third sheet-like electrode being connected to one end of said second attenuation means, the other end of said second attenuation means being connected to said second focusing electrode, said sheet-like electrodes being of the same form and each having a central and two outer electron beams passing apertures, said electron beam passing apertures of said sheet-like electrodes having dimensions greater than the dimensions of said electron beam passing apertures of said first focusing electrode, the inner dimensions of said attenuation means being wide enough not to obstruct said two outer beam-passing apertures of said sheet-like electrodes at both sides of said sheet-like electrodes, thereby forming a lens of large diameter between said first focusing and said second focusing electrode so that the area of the beam spot landing on the screen and the focusing voltage difference between the three electron beams are signficantly reduced.

5. The improvement of claim 4, wherein said electron beam-passing apertures of said sheet-like electrodes are concentric with said electron beam-passing apertures of said first focusing electrode, the outer dimensions of said attenuation means substantially equal to the outer dimensions of its respective one of said first or second focusing electrodes.

6. The improvement of claim 5, wherein said first and second attenuation means have apertures with dimensions greater than the corresponding dimensions of their respective one of said first and second focusing electrodes.

7. The improvement of claim 6, wherein said sheet-like electrodes have aperture inner dimensions intermediate the inner dimensions of the apertures of their respective focusing electrodes and their respective attenuation means.

8. The improvement of claim 4, wherein said first and second attenuation means have apertures with dimensions greater than the corresponding dimensions of said first and second focusing electrodes.

* * * * *